US010679813B2

(12) United States Patent
Grbac et al.

(10) Patent No.: US 10,679,813 B2
(45) Date of Patent: Jun. 9, 2020

(54) YOKE ASSEMBLY WITH DECELERATION ELEMENT FOR SWITCHING DEVICE AND SAME

(71) Applicant: Tyco Electronics EC Trutnov S.R.O., Trutnov (CZ)

(72) Inventors: Vladimir Grbac, Jaromer (CZ); Josef Mladek, Upice (CZ); Radek Mejznar, Lanov (CZ)

(73) Assignee: Tyco Electronics EC Trutnov S.R.O., Trutnov (CZ)

( * ) Notice: Subject to any disclaimer, the term of this patent is extended or adjusted under 35 U.S.C. 154(b) by 232 days.

(21) Appl. No.: 15/453,526

(22) Filed: Mar. 8, 2017

(65) Prior Publication Data

US 2017/0178850 A1 Jun. 22, 2017

Related U.S. Application Data

(63) Continuation of application No. PCT/EP2015/067156, filed on Jul. 27, 2015.

(30) Foreign Application Priority Data

Sep. 10, 2014 (EP) ..... 14184314

(51) Int. Cl.
*H01H 51/22* (2006.01)
*H01H 50/36* (2006.01)
(Continued)

(52) U.S. Cl.
CPC ..... *H01H 50/36* (2013.01); *H01H 50/18* (2013.01); *H01H 50/305* (2013.01); *H01H 50/642* (2013.01); *H01H 50/645* (2013.01)

(58) Field of Classification Search
CPC ..... H01H 50/026; H01H 50/642; H01H 67/26
(Continued)

(56) References Cited

U.S. PATENT DOCUMENTS 2,735,968 A * 2/1956 Bogue et al. ..... H01H 50/26 335/253
2,902,565 A * 9/1959 Angold ..... H01H 50/30 335/129
(Continued)

FOREIGN PATENT DOCUMENTS

CN 201478205 U 5/2010
DE 19848734 A1 5/2000
(Continued)

OTHER PUBLICATIONS

Chinese First Office Action and English translation, dated May 31, 2018, 15 pages.
(Continued)

*Primary Examiner* — Alexander Talpalatski
(74) *Attorney, Agent, or Firm* — Barley Snyder

(57) ABSTRACT

A yoke assembly for an electromagnetic switching device is disclosed. The yoke assembly comprises a yoke and an elastic deceleration element. The yoke has a support face supporting an abutment face of an actuating assembly in a position of the switching device. The elastic deceleration element is mounted on the yoke and has a deceleration face disposed at a distance from the support face.

7 Claims, 3 Drawing Sheets

(51) Int. Cl.
*H01H 50/64* (2006.01)
*H01H 50/30* (2006.01)
*H01H 50/18* (2006.01)

(58) Field of Classification Search
USPC ..... 335/129, 78–83
See application file for complete search history.

(56) References Cited

U.S. PATENT DOCUMENTS 3,260,818 A * 7/1966 Fisher ..... H01H 51/06 335/220
3,493,903 A * 2/1970 Kosar ..... H01H 50/58 335/135
5,227,750 A * 7/1993 Connell ..... H01H 50/08 335/128
5,694,099 A * 12/1997 Connell ..... H01H 1/54 335/128
6,211,761 B1 * 4/2001 Yoshino ..... H01H 50/023 335/281
6,265,958 B1 * 7/2001 Yoshino ..... H01H 50/023 335/128
6,426,689 B1 * 7/2002 Nakagawa ..... H01H 51/2272 335/78
6,798,322 B2 * 9/2004 Copper ..... H01H 50/305 335/128
6,940,375 B2 * 9/2005 Sanada ..... H01H 50/56 335/129
7,679,476 B2 * 3/2010 Kubono ..... H01H 50/043 335/126
7,859,371 B2 * 12/2010 Takano ..... H01H 50/548 335/128
7,932,795 B2 * 4/2011 Kozai ..... H01H 50/642 335/128
7,956,710 B2 * 6/2011 Minowa ..... H01H 50/642 335/129
9,123,494 B2 * 9/2015 Shinkai ..... H01H 51/06
2008/0048808 A1 2/2008 Kozai et al.
2014/0028418 A1 1/2014 Yamashita et al.
2014/0225688 A1 8/2014 Masui et al.
2015/0022295 A1 1/2015 Takaya et al.

FOREIGN PATENT DOCUMENTS

EP 1895560 A2 3/2008
EP 2768004 A1 8/2014
JP 63152131 U 10/1988
JP 2012190764 A 10/2012
JP 2013222561 A 10/2013

OTHER PUBLICATIONS

Abstract of CN201478205U, dated May 19, 2010, 1 page.
Japanese Notice of Reason for Refusal and English translation, dated Feb. 27, 2018, 12 pages.
PCT Notification, Written Opinion of the International Searching Authority, dated Mar. 23, 2017, 6 pages.
PCT Notification, International Search Report and Written Opinion, dated Oct. 23, 2015, 9 pages.
Abstract of DE19848734, dated May 4, 2000, 1 page.

* cited by examiner

YOKE ASSEMBLY WITH DECELERATION ELEMENT FOR SWITCHING DEVICE AND SAME

CROSS-REFERENCE TO RELATED APPLICATIONS

This application is a continuation of PCT International Application No. PCT/EP2015/067156, filed on Jul. 27, 2015, which claims priority under 35 U.S.C. § 119 to European Patent Application No. 14184314.4, filed on Sep. 10, 2014.

FIELD OF THE INVENTION

The present invention relates to an electromagnetic switching device, and more particularly, to a yoke assembly for an electromagnetic switching device.

BACKGROUND

Known electromagnetic switching devices have yoke assemblies commonly including two legs connected to each other via a bend. One of the legs has an electromagnetic element, for example a coil wound around the leg. By energizing the coil, electromagnetic flux is induced into the yoke. An armature is disposed at the ends of the legs opposite the bend, the armature being pulled towards the ends of the legs upon energizing the coil. When the armature abuts the ends of the legs, a magnetic circuit is closed and, consequently, the armature is held at the ends of the legs of the yoke. An actuating assembly including the armature further comprises an actuator mechanically interacting with at least one switching contact of the switching device. Upon energizing the coil, the switching contact may be moved from a first position into a second position, where it is brought in electrical contact with at least one contact element of the switching device.

Electromagnetic switching devices known in the art have the disadvantage that the actuating assembly and the switching contacts produce a noise when impinging an abutment face of the yoke and the counter contact, respectively. Further, when moving back from the energized second position into the de-energized first position, the actuating assembly impinges upon the yoke and/or a housing of the switching device. Switching noise from the respective impacts has an adverse effect both acoustically and through mechanical vibration, especially when the electromagnetic switching device is used in industrial applications where multiple electromagnetic switching devices may be arranged next to each other, amplifying the switching noises.

SUMMARY

A yoke assembly for an electromagnetic switching device according to the invention comprises a yoke and an elastic deceleration element. The yoke has a support face supporting an abutment face of an actuating assembly in a position of the switching device. The elastic deceleration element is mounted on the yoke and has a deceleration face disposed at a distance from the support face.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
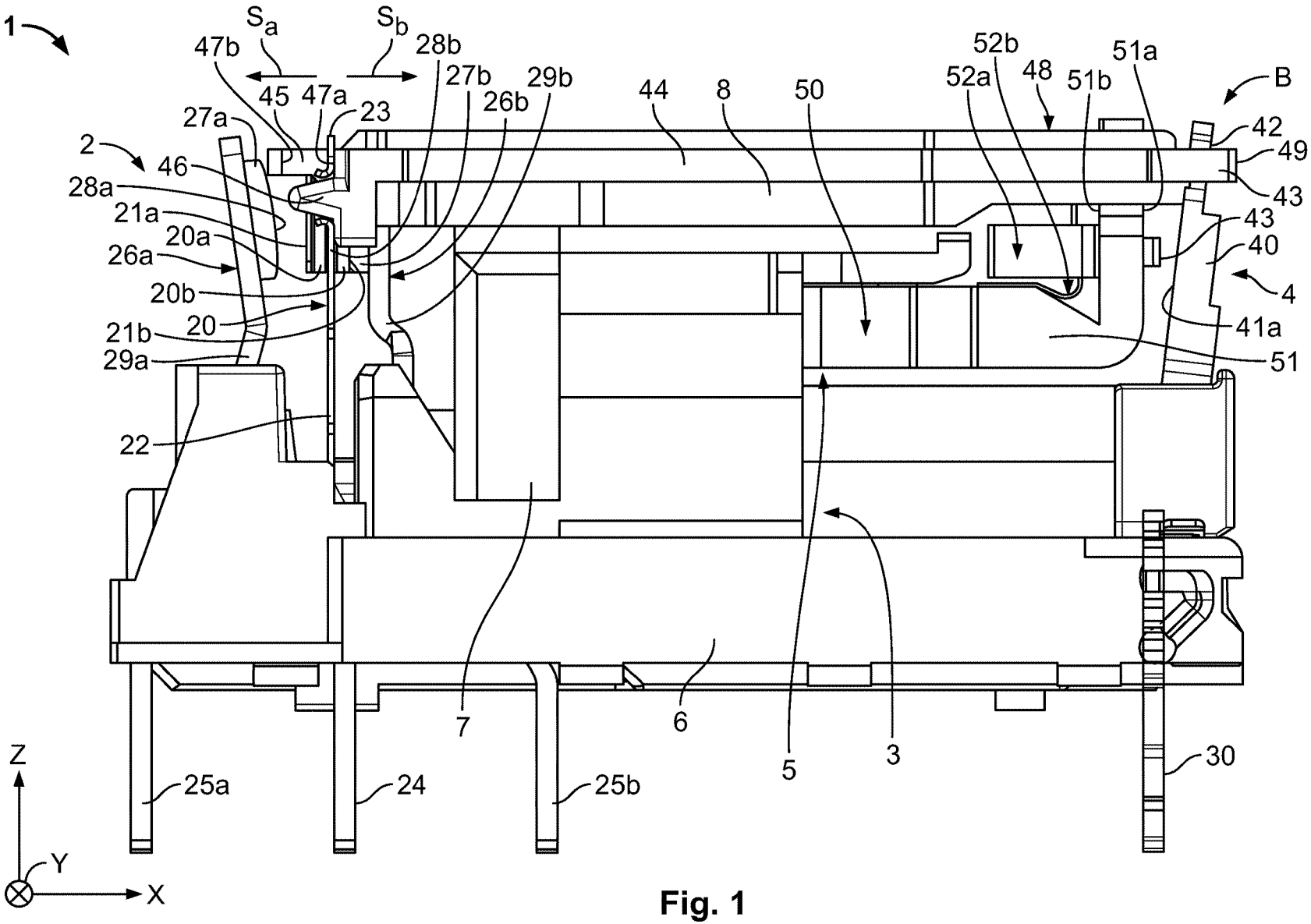
FIG. 1 is a side view of an electromagnetic switching device according to the invention.

Exemplary embodiments of the present invention will be described hereinafter in detail with reference to the drawings, wherein like reference numerals refer to like elements. The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

A switching device 1 according to the invention is shown in FIG. 1. The switching device 1 includes a switching assembly 2, a drive unit 3, an actuating assembly 4, and a yoke assembly 5. The switching assembly 2, the drive unit 3, the actuating assembly 4, and the yoke assembly 5 are mounted on a base 6 of the switching device 1. The switching device 1 further includes a guidance 8 for the actuating assembly 4, the guidance 8 disposed on a frame 7 of the switching device 1.

The switching device 1, as shown in FIG. 1, extends along a longitudinal direction X, a transverse direction Y, and a height direction Z, which run perpendicularly to each other and thus form a Cartesian coordinate system. Henceforth, any mention of front or rear relates to the longitudinal direction X, mentions of left and right relate to the transverse direction Y, and mentions of above and below relate to the height direction Z.

The switching assembly 2, as shown in FIG. 1, includes a switching contact 20 having a first contact element 20*a* and a second contact element 20*b*. The first and second contact elements 20*a*, 20*b* have a first contact face 21*a* and a second contact face 21*b*, respectively, which face in a first switching direction Sa and a second switching direction Sb, respectively. In order to be moveable in the first switching direction Sa and the second switching direction Sb, the first and second contact elements 20*a*, 20*b* are mounted on a displaceable switching contact carrier 22. In the embodiment shown in FIG. 1, the switching contact carrier 22 is a leaf spring that has a holding section 23 electrically connected to a connecting section 24. The switching contact 20 is electrically connected through the connecting section 24 to a connecting element of a device carrying or containing the switching device 1.

The switching assembly 2, as shown in FIG. 1, has a first counter connecting section 25*a* and a second counter connecting section 25*b* electrically connected to a first counter contact 26*a* and a second counter contact 26*b*, respectively. The first counter contact 26*a* and the second counter contact 26*b* have a first counter contact element 27*a* and a second counter contact element 27*b*, respectively. The first counter contact element 27*a* has a first counter contact face 28*a* and the second counter contact element 27*b* has a second counter contact face 28*b*. The first counter contact 26*a* is mounted on a first counter contact carrier 29*a* and the second counter contact 26*b* is mounted on a second counter contact carrier 29*b*. The first counter contact carrier 29*a* is electrically connected to the first counter connecting section 25*a* and the second counter contact carrier 29*b* is electrically connected to the second counter connecting section 25*b*.

The drive unit 3, as shown in FIG. 1, has at least one supply contact element 30 for providing the drive unit 3 with electrical energy. The actuating assembly 4 is moved by interacting with the yoke assembly 5 upon energizing and de-energizing the drive unit 3 via the at least one supply contact element 30. In a second position B of the switching device 1 shown in FIG. 1, the drive unit 3 is in an idle state and the second contact face 21*b* of the second contact element 20*b* abuts the second counter contact face 28*b* of the second counter contact element 27*b*, so that the connecting section 24 and the second counter connecting section 25*b* have the same electrical potential. In a first position A of the switching device 1, the drive unit 3 is in an energized state.

The actuating assembly 4, as shown in FIG. 1, has an armature 40 which is hinged to or at least movably held in the vicinity of the yoke assembly 5 such that the armature 40 is movable with respect to the yoke assembly 5. For abutting the yoke assembly 5, the armature 40 has an abutment face 41*a* that faces in the first switching direction Sa. The armature 40 also has a coupling section 42, with which the armature 40 engages a coupling member 43 of an actuator 44 of the actuating assembly 4. The actuator 44 is slidably held in the first switching direction Sa and the second switching direction Sb along the guidance 8 provided by or fixed on the frame 7.

A switching member 45 of the actuating assembly 4, as shown in FIG. 1, is connected to the actuator 44 and engages the holding section 23 of the switching contact 20. The switching member 45 has a plurality of holding elements 46 engaging the holding section 23. In order to transfer switching forces onto the holding section 23 of the switching contact 20, a first actuating face 47*a* facing essentially in the first switching direction Sa and/or a second actuating face 47*b* facing essentially in the second switching direction Sb are disposed at the switching member 45. The actuator 44 also has a stop face 48 for stopping movements of the actuator 44 in the second switching direction Sb. An end face 49 of the actuator 44 stops movement of the actuator 44 and thereby of the actuating assembly 4 in the second switching direction Sb.

Figure 2:
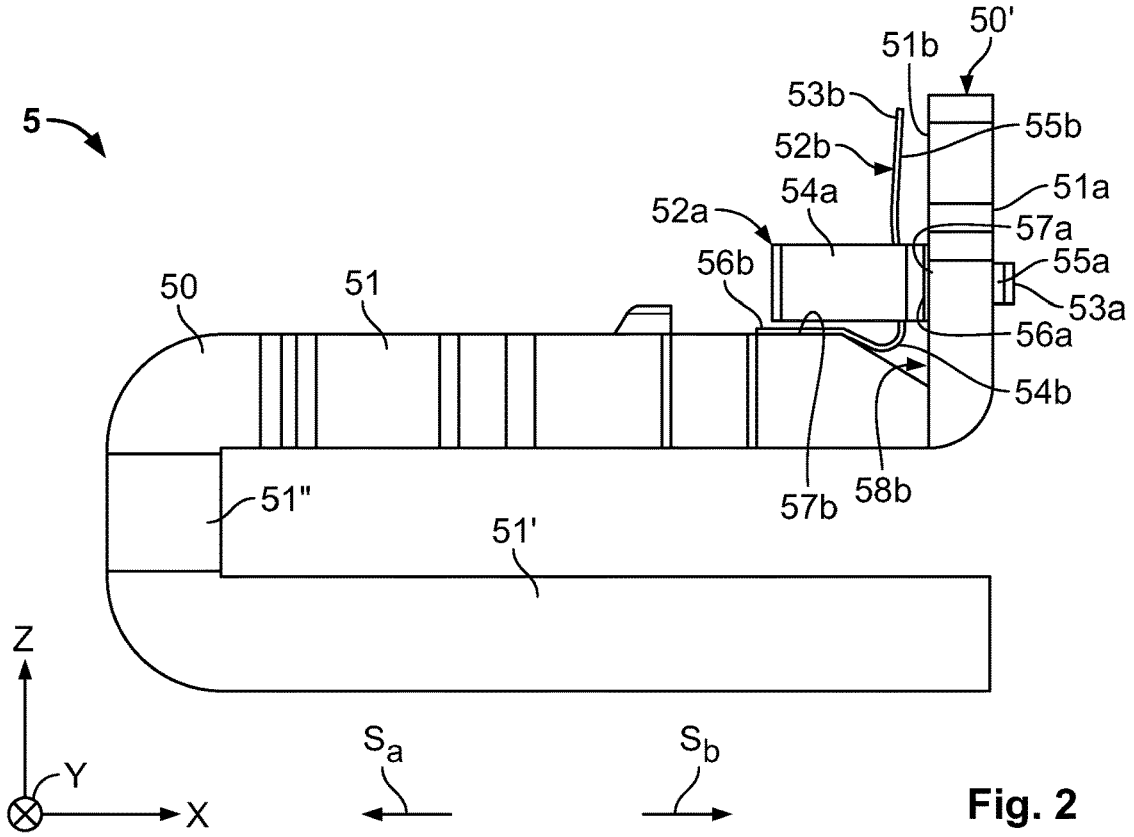
FIG. 2 is a side view of a yoke assembly of the electromagnetic switching device of FIG. 1.

The yoke assembly 5, as shown in FIGS. 1 and 2, has a yoke 50 including a first leg 51 and a second leg 51'. The first leg 51 and the second leg 51' extend essentially in parallel to each other along the longitudinal direction X and, therefore, along the switching directions Sa, Sb. The first leg 51 has a first support face 51*a* and a second support face 51*b* which face in directions opposite to the first switching direction Sa and the second switching direction Sb, respectively. As shown in FIG. 1, the first support face 51*a* supports the abutment face 41*a* of the armature 40 and the second support face 51*b* supports the stop face 48 of the actuator 44.

An elastic first deceleration element 52*a* and an elastic second deceleration element 52*b* are mounted on and/or attached to the yoke 50, in particular the first leg 51 thereof, as shown in FIG. 2. The first deceleration element 52*a* and the second deceleration element 52*b* are integrally formed of a metal or a metal alloy. In one embodiment, the first deceleration element 52*a* and the second deceleration element 52*b* are formed of stainless steel or phosphor bronze. The first deceleration element 52*a* and the second deceleration element 52*b* may be welded or soldered to the yoke 50.

The first deceleration element 52*a* has a first deceleration face 53*a* facing essentially opposite to the first switching direction Sa and a first spring section 54*a* via which a first cushioning section 55*a* is connected to a first mounting section 56*a* of the first deceleration element 52*a* mounted to the first leg 51. The second deceleration element 52*b* has a second deceleration face 53*b* facing essentially opposite to the second switching direction Sb and a second spring section 54*b* via which a second cushioning section 55*b* is connected to a second mounting section 56*b* of the second deceleration element 52*b* mounted to the first leg 51.

As shown in FIG. 2, the first mounting section 56*a* of the first deceleration element 52*a* is connected to a first mounting region 57*a* of the yoke 50 and the second mounting section 56*b* of the second deceleration element 52*b* is connected to a second mounting region 57*b* of the yoke 50. The first mounting section 56*a* faces opposite to the first switching direction Sa and the first mounting region 57*a* faces in the first switching direction Sa. The second mounting section 56*b* and the second mounting region 57*b* face in directions perpendicular to the switching directions Sa, Sb, opposite and in the height direction Z, respectively. The first deceleration face 53*a* and the second deceleration face 53*b* are disposed at the first cushioning section 55*a* and the second cushioning section 55*b*, respectively.

The yoke 50 also has an extension 50' as shown in FIG. 2 which is formed at or attached to the first leg 51 and extends essentially perpendicular to the switching directions Sa, Sb. The support faces 51*a*, 51*b* of the first leg 51 and the mounting regions 57*a*, 57*b* of yoke 50 are disposed at the extension 50'. The first leg 51 and the second leg 51' are connected to each other via a bend 51". A recess 58*b* is disposed between the extension 50' and the first leg 51, the recess 58*b* at least partially accommodating the second spring section 54*b* of the second deceleration element 52*b*.

Figure 3:
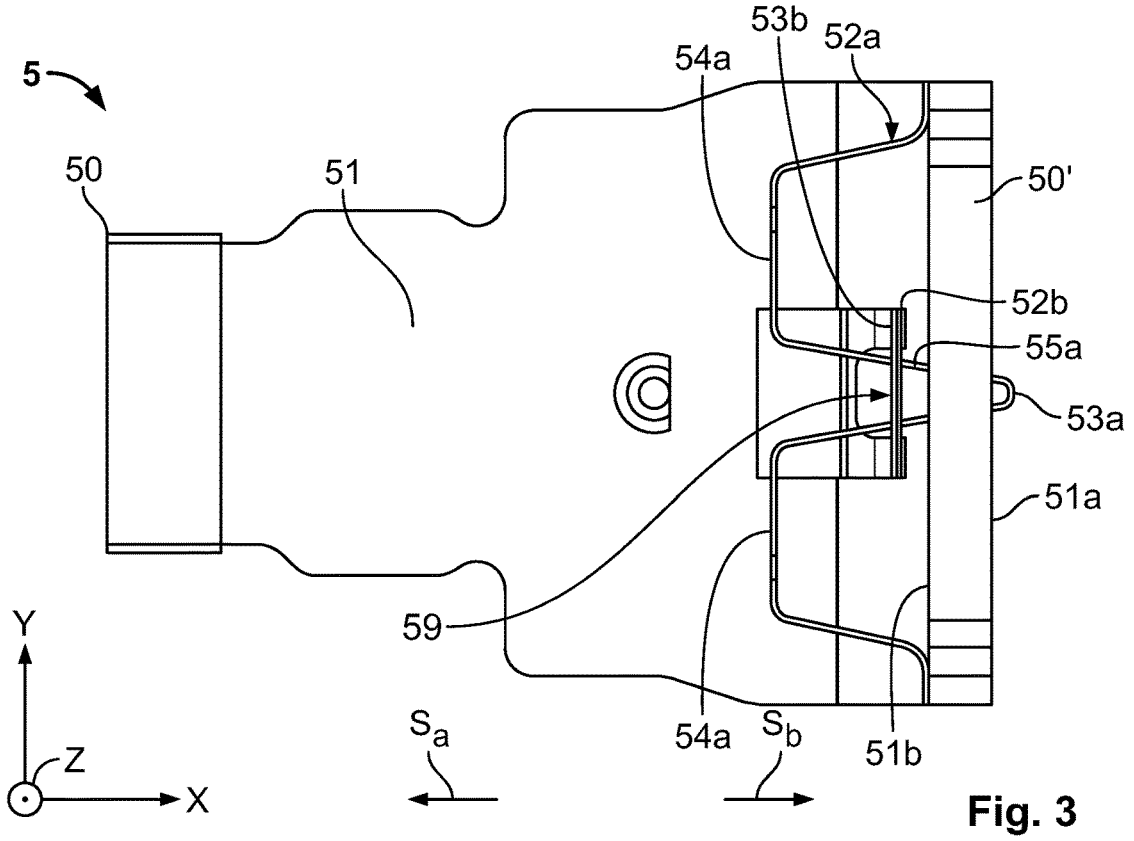
FIG. 3 is a top view of the yoke assembly of FIG. 2.
Figure 4:
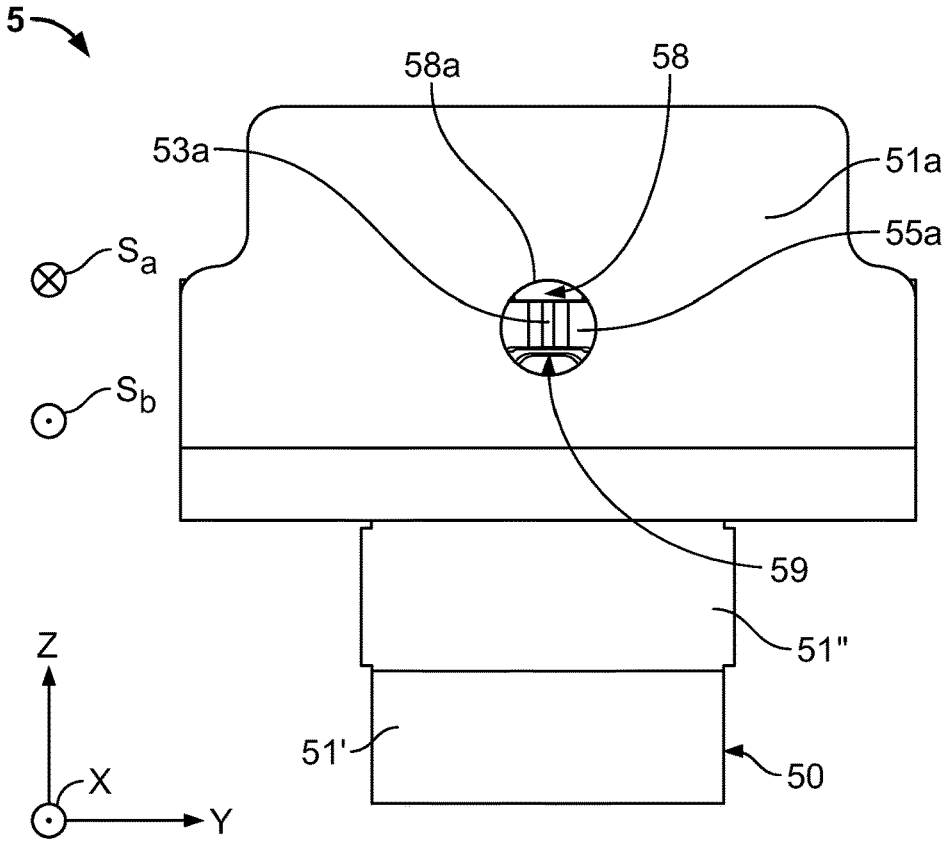
FIG. 4 is a front view of the yoke assembly of FIG. 2.

As shown in FIG. 3, the first deceleration face 53*a* of the first deceleration element 52*a* protrudes from the first support face 51*a* opposite to the first switching direction Sa. The second deceleration face 53*b* of the second deceleration element 52*b* is held at a distance from the second support face 51*b* opposite to the second switching direction Sb. The first deceleration element 52*a* interleaves with the second deceleration element 52*b* in that the first deceleration element 52*a*, in particular the first cushioning section 55*a* thereof, extends through a cut-out 59 formed in the second deceleration element 52*b*, in particular the spring section 54*b* and/or second cushioning section 55*b* thereof. As shown in FIG. 4, the cut-out 59 also extends through the extension 50' of the yoke 50 and forms an opening 58*a* through which the first cushioning section 55*a* and thus the first deceleration face 53*a* of the first deceleration element 52*a* may be displaced in the first switching direction Sa. The opening 58*a*, as shown in FIG. 4, is a through-hole 58 extending through the first support face 51*a* of the yoke 50.

The switching contact 20 is transferable by the drive unit 3 in a closing direction from the second position B, wherein the drive unit 3 is in the idle state, to the first position A, wherein the driving unit 3 is in the energized state. In the first position A, the switching contact 20 abuts the first counter contact 26*a* in an electrically conductive manner, and in the second position B, the switching contact 20 abuts the second counter contact 26*b* in an electrically conductive manner.

During motion from the second position B to the first position A, moving along the first switching direction Sa, the abutment face 41*a* of the actuating assembly 4 impinges on the first deceleration face 53*a* of the first deceleration element 52*a* protruding from the first support face 51*a* before impinging on the first support face 51*a* of the first leg 51, as shown in FIGS. 1 and 2. The first deceleration face 53*a* is elastically displaceable at the first spring section 54*a*, and consequently absorbs energy of the actuating assembly 4 and switching contact 20, slowing motion of the actuating assembly 4 in the first switching direction Sa. The actuating assembly 4 is thus decelerated before arriving at the yoke 50 and an impact noise between the actuating assembly 4 and the yoke 50 is significantly reduced. The switching contact 20 connected to the actuating assembly 4 is also decelerated before the second contact element 20*b* arrives at the second counter contact 26*b* and an impact noise between the second contact element 20*b* and the second counter contact 26*b* is significantly reduced. In the first position A, the abutment face 41*a* still lies flush against the first support face 51*a* of the first leg 51 and, consequently, the deceleration effect of the first deceleration face 53*a* of the first deceleration element 52*a* does not compromise the switching of the switching device 1.

During motion from the first position A to the second position B, moving along the second switching direction Sb, the stop face 48 of the actuator 44 impinges on the second deceleration face 53*b* of the second deceleration element 52*b* held at a distance from the second support face 51*b* before impinging on the second support face 51*b* of the first leg 51, as shown in FIGS. 1 and 2. The second deceleration face 53*b* is elastically displaceable at the second spring section 54*b*, and consequently absorbs energy of the actuating assembly 4 and switching contact 20, slowing motion of the actuating assembly 4 in the second switching direction Sb. The actuating assembly 4 is thus decelerated before arriving at the yoke 50 and an impact noise between the actuating assembly 4 and the yoke 50 is significantly reduced. The switching contact 20 connected to the actuating assembly 4 is also decelerated before the first contact element 20*a* arrives at the first counter contact 26*a* and an impact noise between the first contact element 20*a* and the first counter contact 26*a* is significantly reduced. In the second position B, the stop face 48 still lies flush against the second support face 51*b* of the first leg 51, and consequently, the deceleration effect of the second deceleration face 53*b* of the second deceleration element 52*b* does not compromise the switching of the switching device 1.

The first deceleration element 52*a* and the second deceleration element 52*b*, as shown in FIGS. 2 and 3, are disposed symmetrically with respect to a plane extending perpendicularly to the first deceleration face 53*a* and the deceleration face 53*b*, respectively. Thereby, forces to be absorbed by the first deceleration element 52*a* and the second deceleration element 52*b* as described above are evenly distributed and the actuating assembly 4 moves in parallel to the switching directions Sa, Sb during deceleration.

Figure 5:
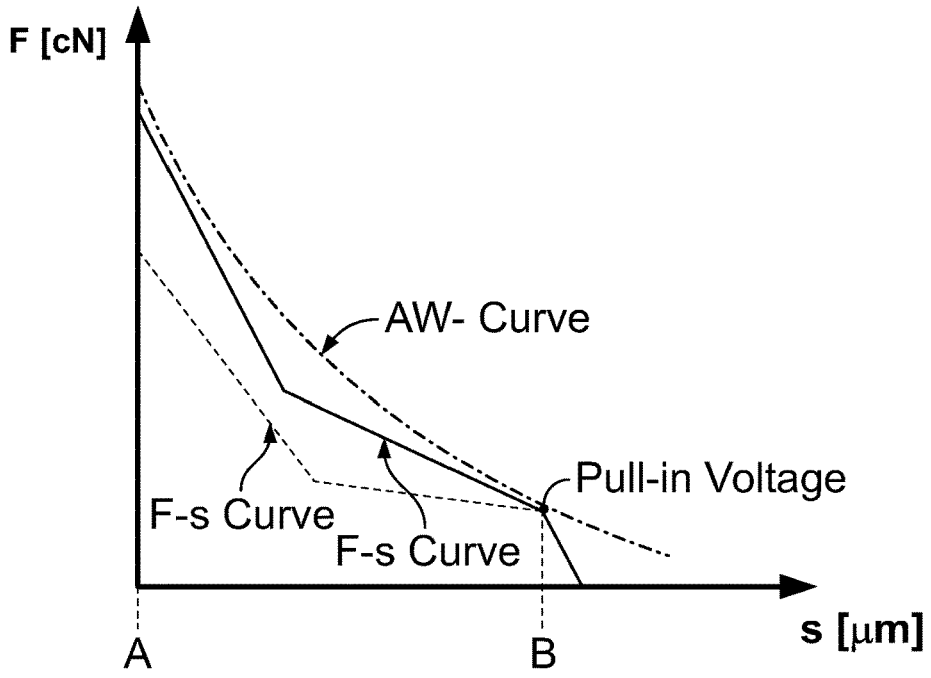
FIG. 5 is a graph of a deceleration effect of the electromagnetic switching device of FIG. 1.

Deceleration forces of the first deceleration element 52*a* and the second deceleration element 52*b* during transfer of the switching contact 20 by the drive unit 3 are shown graphically in FIG. 5. The dashed and dotted lines show force exerted by the drive unit 3 at the extension 50' of the yoke 50 upon energizing the drive unit 3 with a pull-in voltage in the second position B shown in FIG. 1. The force (AW-curve) increases when moving the actuating assembly 4 along the first switching direction SA until reaching the first position A. The dashed line illustrates a force over distance diagram (F-s curve) which would be exerted from the yoke assembly 5 on the actuating assembly 4, in particular on the armature 40 thereof, when no deceleration element 52*a*, 52*b* is present. The area between the dashed and dotted AW-curve and the dashed F-s curve is equivalent to the impulse of the actuating assembly 4. By adding at least one deceleration element 52*a*, 52*b*, the dashed F-s curve is transferred into the solid F-s curve showing that the impulse and thus impact noise of the actuating assembly 4 on the yoke assembly 5 is significantly reduced.

The switching device 1 may have switching assemblies 2, drive units 3, actuating assemblies 4, yoke assemblies 5, bases 6, frames 7 and guidances 8 in any form or number desired for performing the switching of electrical currents.

What is claimed is:

1. A yoke assembly for an electromagnetic switching device, comprising:

a yoke having a first support face supporting an abutment face of an actuating assembly in a first position of the switching device and a second support face supporting a stop face of the actuating assembly in a second position of the switching device; and a plurality of elastic deceleration elements mounted on the yoke, a first elastic deceleration element having a first deceleration face disposed at a distance from the first support face and facing opposite to a first switching direction of the switching device, and a second elastic deceleration element having a second deceleration face disposed at a distance from the second support face and facing in the first switching direction opposite to a second switching direction of the switching device, the first elastic deceleration element and the second elastic deceleration element interleaving in a direction perpendicular to the first switching direction and the second switching direction.

2. A yoke assembly for an electromagnetic switching device, comprising:

a yoke having a first support face supporting an abutment face of an actuating assembly in a first position of the switching device and a second support face supporting a stop face of the actuating assembly in a second position of the switching device; and a plurality of elastic deceleration elements mounted on the yoke, a first elastic deceleration element having a first deceleration face disposed at a distance from the first support face and facing opposite to a first switching direction of the switching device, and a second elastic deceleration element having a second deceleration face disposed at a distance from the second support face and facing in the first switching direction opposite to a second switching direction of the switching device, the first deceleration element extending through a cut-out formed in the second deceleration element.

3. An electromagnetic switching device, comprising:

an electrical drive unit;

an actuating assembly having an armature with an abutment face and an actuator with a stop face; and a yoke assembly including a yoke having a first support face supporting the abutment face in a first position of the switching device, a second support face disposed on a side of the yoke opposite the first support face in a switching direction of the switching device and supporting the stop face in a second position of the switching device, and an elastic deceleration element mounted on the yoke and having a deceleration face disposed at a distance from the first support face or the second support face, in the first position of the switching device both the first support face and the deceleration face abut the abutment face.

4. The electromagnetic switching device of claim 3, wherein the actuating assembly is movable with respect to the first support face.

5. The electromagnetic switching device of claim 4, wherein, in the second position of the switching device, the abutment face is disposed at a distance from the first support face.

6. The electromagnetic switching device of claim 5, wherein, in the second position, the elastic deceleration element protrudes from the first support face towards the abutment face.

7. A yoke assembly for an electromagnetic switching device, comprising:

a yoke having a first support face supporting an abutment face of an actuating assembly in a first position of the switching device and a second support face supporting a stop face of the actuating assembly in a second position of the switching device; and a plurality of elastic deceleration elements mounted on the yoke, a first elastic deceleration element having a first deceleration face disposed at a distance from the first support face and facing opposite to a first switching direction of the switching device, and a second elastic deceleration element having a second deceleration face disposed at a distance from the second support face and facing opposite to a second switching direction of the switching device, the first deceleration element extends through a cut-out formed in the second deceleration element.

* * * * *